United States Patent [19]

Kelley

[11] 4,270,969

[45] Jun. 2, 1981

[54] FINGERLESS SINGLE FACER

[75] Inventor: Lawrence R. Kelley, Philadelphia, Pa.

[73] Assignee: Molins Machine Company, Inc., Cherry Hill, N.J.

[21] Appl. No.: 122,952

[22] Filed: Feb. 20, 1980

[51] Int. Cl.[3] ..... B31F 1/28

[52] U.S. Cl. ..... 156/473; 29/115; 29/121.5; 29/121.6; 156/497; 226/95; 271/112; 425/369; 425/388; 425/396

[58] Field of Search ..... 156/462, 470, 472, 473, 156/497; 425/369, 388, 396; 29/114, 115, 121.5, 125, 121.6, 130; 271/94, 95, 96, 112, 196, 271; 226/95; 352/184

[56] References Cited

U.S. PATENT DOCUMENTS

| | | | |
|---|---|---|---|
| 657,100 | 9/1900 | Ferres | 156/472 |
| 1,264,506 | 4/1918 | Hahn | 156/473 |
| 1,981,338 | 11/1934 | Swift | 156/473 |
| 2,068,155 | 1/1937 | Swift | 156/473 |
| 2,995,361 | 8/1961 | Lopez | 271/94 |
| 3,171,647 | 3/1965 | Bishop | 271/94 |
| 3,390,040 | 6/1968 | Moser et al. | 156/473 |
| 3,774,907 | 11/1973 | Borostyan | 271/196 |
| 3,837,973 | 9/1974 | Asakura | 156/473 |
| 3,907,189 | 9/1975 | Collausig | 226/95 |
| 3,947,206 | 5/1976 | Delight et al. | 156/473 |
| 4,177,102 | 12/1979 | Tokuno | 156/472 |

FOREIGN PATENT DOCUMENTS

| | | | |
|---|---|---|---|
| 3713782 | 9/1960 | Japan | 156/473 |
| 2005595 | 4/1979 | United Kingdom . | |

*Primary Examiner*—Jerome W. Massie

*Attorney, Agent, or Firm*—Seidel, Gonda, Goldhammer & Panitch

[57] ABSTRACT

A single facer machine for making a corrugated web is provided with a vacuum means for retaining a corrugated medium on one of the corrugating rolls. Said one corrugating roll has a core through which a heated fluid may flow. The core is surrounded by a sleeve which contains peripheral longitudinally extending flutes and valleys meshed with corresponding flutes and valleys on the other corrugating roll. A plurality of suction hoods are juxtaposed to and sealed to the outer periphery of said sleeve.

6 Claims, 5 Drawing Figures

FIG. 1
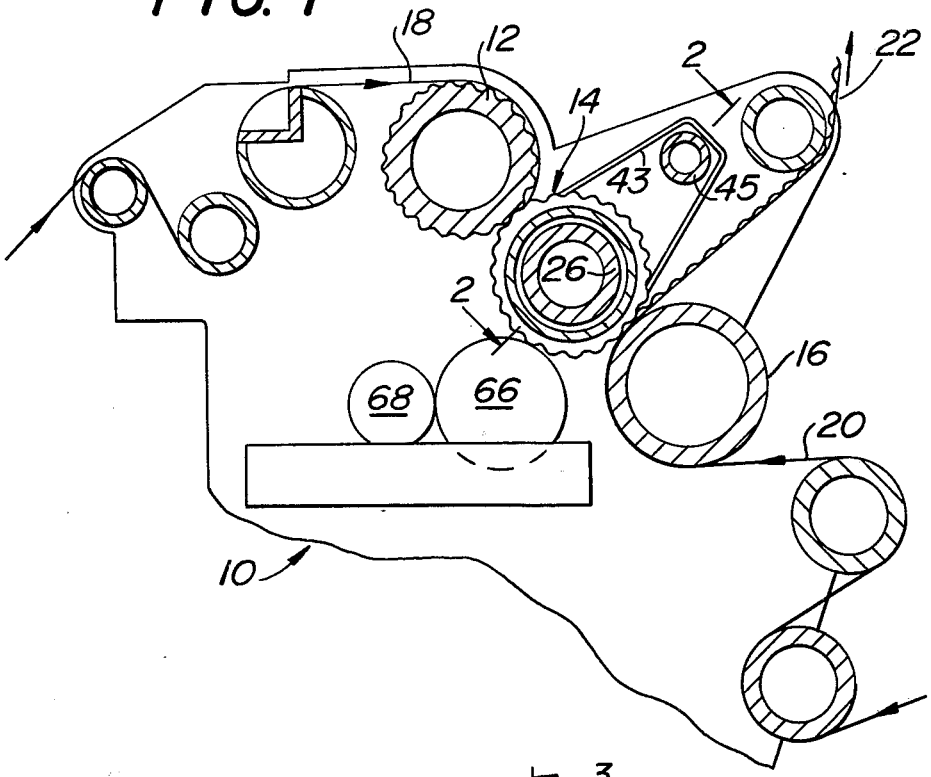
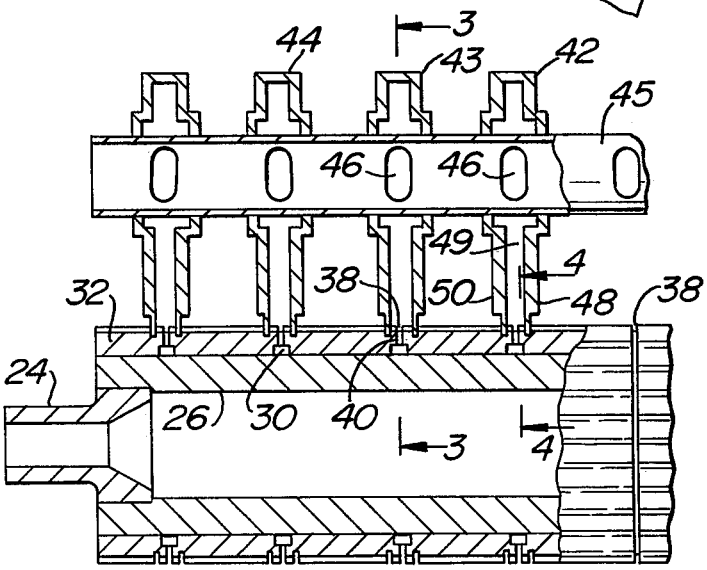
FIG. 2

FINGERLESS SINGLE FACER

BACKGROUND

Single facer machines for making corrugated paperboard webs are well-known to those skilled in the art. In a typical modern single facer machine, a web of medium passes between meshing corrugating rolls and thereafter is held in the flutes of one of the corrugating rolls by fingers. For example, see Finger 54 in U.S. Pat. No. 3,390,040.

It is known to use vacuum in connection with one of the corrugating rolls to eliminate the fingers. Generally, fingers are objectionable in that they result in non-adhered streaks in the laminated singleface web. U.S. Pat. No. 657,100 discloses suction shields designated I, ID' juxtaposed to corrugating rolls for drying the web. U.S. Pat. No. 1,981,338 discloses circumferential grooves in a corrugating roll for receiving a suction tube which has holes for causing the web to adhere to the corrugating roll. U.S. Pat. No. 2,068,155 discloses two suction tubes interconnected by a groove in the corrugating roll for causing the web to adhere to the corrugating roll. British Published Application No. 2,005,595 discloses a single housing in place of the two suction tubes in the last mentioned patent and grooves in the corrugating roll for causing the web to adhere to the corrugating roll.

In addition, U.S. Pat. No. 3,947,206 teaches the utilization of longitudinal conduits connected to an external manifold to introduce suction through radial holes to the corrugated medium. U.S. Pat. No. 4,177,102 discloses guides which enter peripheral grooves in a corrugating roll.

A typical single facer machine has first and second corrugating rolls for corrugating a web passing therebetween. The rolls have mating longitudinally extending flutes. In connection with such a machine, it is known to eliminate fingers and provide a means for applying suction to the second corrugating roll for retaining the corrugated web on approximately one-half of the perimeter of the second roll. Over said approximate one-half perimeter of the second corrugating roll, suction retains the corrguated web in the longitudinally extending flutes. The one-half perimeter of the second corrugating is that portion of the circumference between the nip of the corrugating rolls and the nip between the lower corrugating roll and the pressure roll adjacent the glue mechanism.

SUMMARY OF THE INVENTION

In such a single facer, the present invention is directed to the improvement of how to communicate suction to a second corrugating roll which preferably has a hollow core member through which a heated fluid may flow. A sleeve preferably surrounds and is secured to the core member. The longitudinally extending flutes are on the outer perimeter of the sleeve.

A means for applying suction to the second corrugating roll includes a plurality of hoods each partially enclosing a narrow portion of the perimeter of the second corrugating roll opposite the one-half perimeter. The hoods have wall edges each disposed in an annular slot to confine the suction effect to the hood and the enclosed portion of the perimeter of the second corrugating roll. The suction effect is thus directed only to the effective area of use.

It is an object of the present invention to provide a fingerless single facer machine which enables corrugating rolls to be internally heated by passing a fluid therethrough while at the same time using suction in a most efficient manner to retain a corrugated web on a portion of the perimeter of one of the corrugating rolls.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is a diagramatic sectional view through a single facer.

FIG. 2 is a sectional view of the meshed corrugating taken along the line 2—2 in FIG. 1.

DETAILED DESCRIPTION

Figure 3:
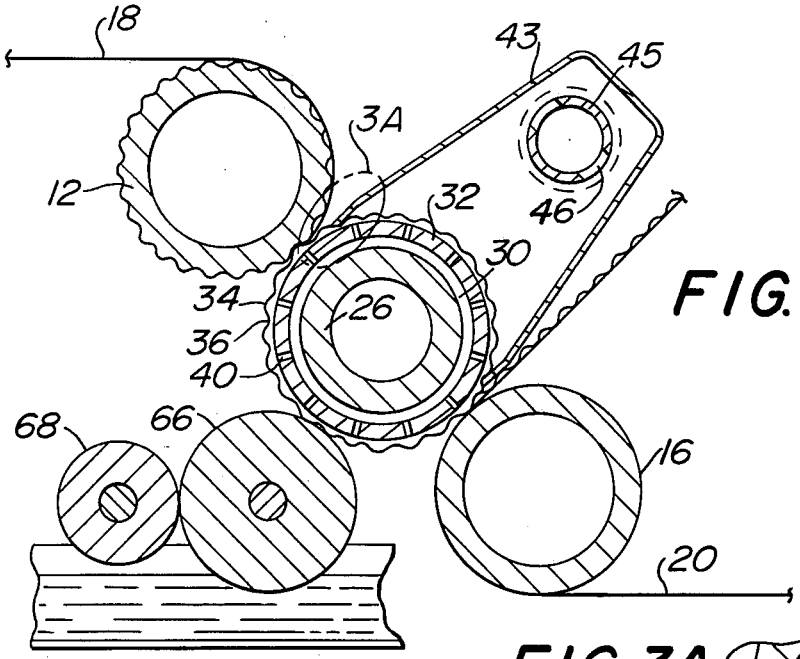
FIG. 3 is a sectional view taken along the line 3—3 in FIG. 2.

Referring to the drawing in detail, wherein like numerals indicate like elements, there is a diagramatically illustrated in FIG. 1 a single facer designated generally as 10. The single facer 10 is conventional except for the lower corrugating roll and the suction apparatus associated therewith.

The corrugator 10 includes an upper or first corrugating roll 12, and a lower or second corrugating roll 14 which are juxtaposed in meshed engagement by way of longitudinally extending flutes. A pressure roll 16 is juxtaposed to the lower corrugating roll 14. Each of rolls 12, 14 and 16 is hollow and may be internally heated by a fluid such as steam or oil. In the single facer machine 10, a medium 18 is corrugated by the rolls 12 and 14 and bonded to a liner 20. The laminated web is a single facer web designated as 22.

Figure 3A:
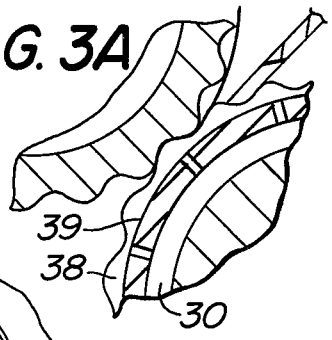
FIG. 3A is an enlargement of a detail in FIG. 3.
Figure 4:
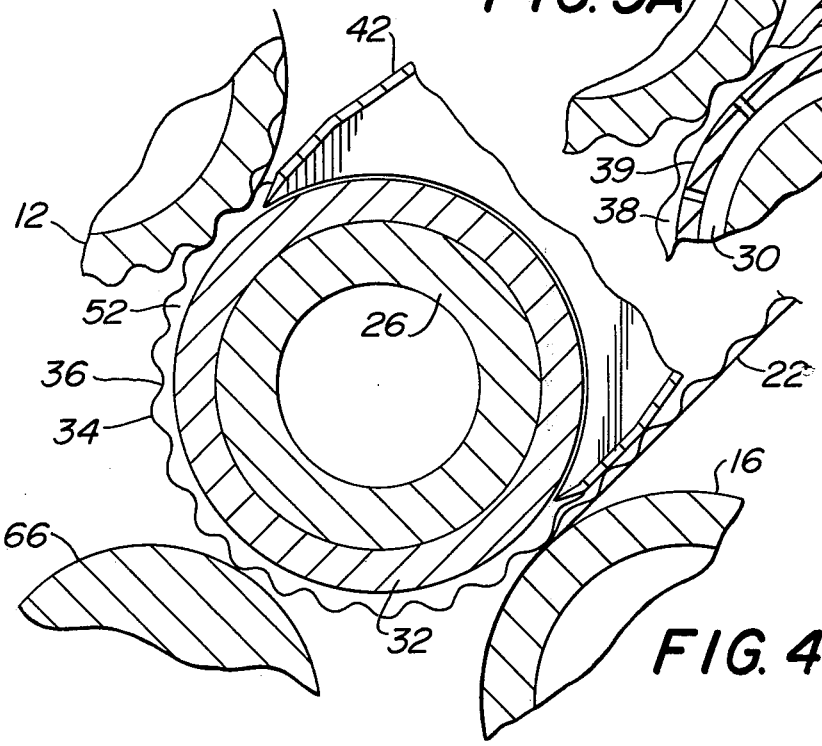
FIG. 4 is a sectional view taken along the line 4—4 in FIG. 2.

Referring to FIGS. 2 and 3, the lower corrugating roll 14 includes journals 24 at its ends (only one shown) for supporting a hollow core 26. Core 26 may be heat shrunk onto the journals 24 to thereby define a vessel through which a heated fluid may pass. A sleeve 32 surrounds and is heat shrunk or otherwise secured onto the outer periphery of core 26. Sleeve 32 has longitudinally extending flutes comprising crests 34 and valleys 36 which are in mating engagement with corresponding crests and velleys on the upper corrugating roll 12. The sleeve 32 has circumferential suction slots 38 at spaced points therealong. Each slot 38 intersects each of the valleys 36 and is deeper than such valleys 36 as shown more clearly in FIG. 3A. Each of the slots 38 has a plurality of radially directed holes 40 extending from the bottom surface 39 to the inner periphery of sleeve 32. The slots 38 are aligned longitudinally with the grooves 30 on the inner periphery of sleeve 32 so that holes 40 communicate slots 38 with grooves 30. Preferably, the diameter of holes 40 is less than the width of the slots 38. The depth of the slots 38 is greater than that of the flutes which, as is known to those skilled in the art, may be A-, B-, C- or E-flute.

A plurality of suction hoods 42, 43, 44, etc. are supported by a suction manifold 45 on the single facer 10 adjacent approximately 180° of the perimeter of the lower corrugating roll 14. Each hood has suction communicated thereto by way of a passage 46 in manifold 45 which in turn communicates with a vacuum pump not shown. A narrow suction chamber 49 is provided within each of the hoods between the sidewalls 48 and 50. Sidewalls 48 and 50 terminate in arcuate generally semi-circular edges which extend into one of the slots 52 on the sleeve 32. The slots 52 are sealing slots and are provided in pairs with each pair straddling one of the suction slots 38. Hence the width of hood 42 between walls 48, 50 is very narrow, such as ½ inch.

In operation, suction from each chamber 49 is communicated to the medium 18 while the latter is on approximately one-half of the perimeter of the lower corrugating roll 14. Such communication from chamber 49 is by way of holes 40 on one-half of the sleeve. The lower edges of the hoods strip the single faced paperboard web 22 from lower corrugating roll 14.

The suction effect is applied in narrow zones at spaced locations along the lower corrugating roll 14. The suction effect on the medium 18 eliminates the necessity for fingers which have been conventional heretofore. Adhesive is applied to the crests of the medium 18 while it is on the lower corrugating roll 14 by the applicator roll 66. Roll 66 may be provided with a doctor roll 68.

The present invention eliminates the necessity for fingers. By utilizing an outer sleeve for the portion of the roll having the corrugations thereon, material specification of the roll as well as heat treating are simplified. Options on choices of materials are provided so that the optimum material for core 26 may be chosen separately from the optimum material for the sleeve 32. At the same time, there is provided a lower corrugating roll which may be internally heated by liquid or gas. The suction effect is limited to narrow zones for efficient use with a small vacuum pump.

If internal heating is not desired, then the interior of core 26 may be manifold, with core 26 and sleeve 32 being one integral piece. In that event, grooves 30 would be eliminated.

The present invention may be embodied in other specific forms without departing from the spirit or essential attributes thereof and, accordingly, reference should be made to the appended claims, rather than to the foregoing specification, as indicating the scope of the invention.

I claim:

1. In a single facer machine having first and second corrugating rolls provided with longitudinally extending meshing flutes for corrugating a web of material passing therebetween, and suction means for restraining the corrugated web on approximately one-half the perimeter of said second roll, the improvement comprising:

a. said second roll having a plurality of spaced annular slots in the outer periphery thereof, a plurality of channels extending radially inwardly from each slot, said suction means including a plurality of hoods disposed side by side, each hood being arranged for applying a narrow zone of suction to one of said annular slots, each hood being diametrically opposite said one-half perimeter, each hood having side walls terminating in concave side edges, the side edges of each hood being sealed in slots on said second corrugating roll and straddling an associated annular slot, and means communicating with said channels on said perimeter one-half with an associated hood in all rotative positions of said second roll.

2. In a machine in accordance with claim 1 including a common suction manifold communicating with and supporting each hood.

3. In a machine in accordance with claim 1 wherein each hood has a cross sectional area which decreases in a direction radially outwardly from said second roll with the minimum cross sectional area adjacent to a common suction manifold for said hoods.

4. In a single facer machine having first and second corrugating rolls provided with longitudinally extending meshing flutes for corrugating a web of material passing therebetween, and suction means for retaining the corrugated web on approximately one-half the perimeter of said second roll, the improvement comprising:

(a) said second corrugating roll having a central hollow core for receiving a heated fluid;

(b) a sleeve surrounding and secured to said hollow core, said sleeve having a plurality of spaced annular slots in the outer perimeter thereof, a plurality of circumferential grooves at the interface of said core and sleeve, each groove being radially coincident with an annular slot, each annular slot communicating with a mating circumferential groove through a plurality of channels extending radially from the inner periphery of the slots to its mating groove; and, (c) means for applying suction to said second corrugating roll to hold the corrugated web thereon, said means including a plurality of hoods for applying a narrow zone of suction to said annular slots, each hood being diametrically opposite said one-half perimeter, and the edges of each hood being sealed to said second corrugating roll and straddling one of said annular slots.

5. In a single facer machine having first and second corrugating rolls provided with longitudinally extending meshing flutes for corrugating a web of material passing therebetween, and suction means for retaining the corrugated web on approximately one-half the perimeter of said second roll, the improvement comprising:

a. said second roll having a central hollow core for receiving a heated fluid, b. a sleeve surrounding and secured to said hollow core, means defining a plurality of circumferential grooves at spaced locations along the interface of said core and sleeve, said sleeve having a plurality of spaced annular slots in the perimeter thereof, the longitudinally extending flutes of the second roll being on the perimeter of said sleeve, said sleeve having a plurality of passages extending from each of said annular slots to one of said grooves.

c. said suction means applying suction to said second corrugating roll by way of said grooves, slots and passages to hold the corrugated web on said one-half of the perimeter of said second corrugating roll, said suction means including a plurality of hoods disposed diametrically opposite said one-half perimeter, said hoods having edges extending into sealing grooves on the outer periphery of said second corrugating roll, and a suction manifold communication with each of said hoods.

6. In a machine in accordance with claim 5 wherein annular slots are provided in the outer perimeter of said sleeve and deeper than the depth of said flutes, each suction slot being straddled by a pair of the sealing grooves associated with one of said hoods.

* * * * *